US006675846B1

(12) United States Patent
Hoffman

(10) Patent No.: US 6,675,846 B1
(45) Date of Patent: Jan. 13, 2004

(54) LINEAL LOG PEELER AND DEBARKER FOR USE IN LOG HOME CONSTRUCTION

(76) Inventor: James D. Hoffman, 6137 Hillcrest Rd., Medford, OR (US) 97504

( * ) Notice: Subject to any disclaimer, the term of this patent is extended or adjusted under 35 U.S.C. 154(b) by 0 days.

(21) Appl. No.: 10/231,871

(22) Filed: Aug. 29, 2002

(51) Int. Cl.[7] ..... B27L 1/00

(52) U.S. Cl. ..... 144/208.6; 144/3.1; 144/208.1; 144/250.25; 144/341

(58) Field of Search ..... 144/1.1, 3.1, 208.1, 144/208.6, 250.25, 341

(56) References Cited

U.S. PATENT DOCUMENTS

| | | | | | |
|---|---|---|---|---|---|
| 1,905,387 | A | * | 4/1933 | Kirkwood | 144/208.6 |
| 2,263,036 | A | * | 11/1941 | Flateboe et al. | 144/208.6 |
| 2,608,223 | A | * | 8/1952 | Eklund et al. | 144/208.6 |
| 3,016,074 | A | * | 1/1962 | Baker et al. | 144/208.6 |
| 3,082,801 | A | * | 3/1963 | Dillingham | 144/208.6 |
| 3,791,430 | A | * | 2/1974 | Hood et al. | 144/3.1 |
| 3,848,647 | A | * | 11/1974 | Fell | 144/3.1 |
| 3,951,187 | A | * | 4/1976 | Chisum | 144/1.1 |
| 4,249,585 | A | * | 2/1981 | Mellott | 144/208.6 |
| 4,579,159 | A | | 4/1986 | Platt | 144/209 |
| 4,595,041 | A | | 6/1986 | Fox et al. | 144/208 D |
| 4,784,196 | A | | 11/1988 | Pousette | 144/341 |
| 4,901,777 | A | | 2/1990 | Koike | 144/213 |
| 5,797,437 | A | | 8/1998 | Beeson | 144/208.1 |
| 6,363,672 | B1 | | 4/2002 | Baker | 52/233 |

OTHER PUBLICATIONS

Homestead Machinery Sales, Nordic Peeler, Sales Brochure.
WG Benjey, product information downloaded from Internet.
Senty, Building with Logs, information downloaded from Internet.

* cited by examiner

*Primary Examiner*—W. Donald Bray
(74) *Attorney, Agent, or Firm*—Lori M. Friedman

(57) ABSTRACT

The invention discloses a lineal log peeler and debarker that debarks logs for use in home construction automatically by, an operator in a protected control booth. The machine is electronically controlled and replaces the difficult, dangerous and time-consuming operation of hand-peeling such logs with a drawknife. The logs debarked by the machine of this invention can range in length from about 6 to over 50 feet. They can range from about 7 to about 21 inches in diameter and weigh up to about 3000 pounds.

22 Claims, 7 Drawing Sheets

LINEAL LOG PEELER AND DEBARKER FOR USE IN LOG HOME CONSTRUCTION

BACKGROUND OF THE INVENTION

1. Field of the Invention

The present invention is directed to a machine that peels and debarks logs for use in the log home construction industry. More specifically, the machine of this invention produces peeled logs that simulate a hand-hewn, drawknife effect while replacing the need to have logs peeled by hand.

2. Background of the Invention

Log homes have been known and used as dwellings for centuries. In recent times, log homes have surged in popularity and there has been a substantial increase in the construction of log cabins and homes. The demand for log homes may result from their beauty, longevity and natural insulation properties. The latter is especially important in freezing and subfreezing mountain weather.

The construction of a log home is a demanding task, due to the raw state of the construction materials. The first steps in building a log home are to select and dry the logs and then to peel the bark off the logs. If a hand-hewn look is desired, the bark must be peeled off the logs in a manner that results in a relatively smooth surface along the natural contours of the logs. A method of peeling a log that would leave gouges or grooves in the log would substantially detract from the beauty of a log home. There is a desire to reduce the amount of labor required to properly peel the logs while insuring that the natural contours of the logs are retained.

In the past, hand-hewn logs were attained by manually peeling logs with a draw knife. A draw knife is designed with a handle on each end of a blade with a bevel on one edge. A person operates a manual draw knife by straddling a felled log, placing the draw knife on the log with the bevel on the blade facing the log, and then dragging the draw knife along the log. The blade of the draw knife cuts through the bark and cambium layers of wood. The dragging action pulls the draw knife blade along the top of the hard layers of wood leaving them intact. The result is a relatively smooth peeled surface along the contour of the log. This method of attaining a hand hewn log is very labor intensive, hazardous, time consuming, and not economically attractive.

Due perhaps to the popularity and desirability of log home ownership, there are a plurality of web sites relating to log homes. Indeed, manufacturers of log homes and accessories for them are easily accessed in all parts of the United States and Canada. There is an internet link at http://loghomelinks.com that features over 400 links to builders, manufacturers and accessories for those interested in this art.

Concerning patents, in U.S. Pat. No. 6,363,672 Baker discloses a log home construction and methods. Peeling or otherwise debarking the logs is not addressed in this patent. In U.S. Pat. No. 5,797,437 Beeson discloses a log peeler designed to be operated by one person with the aid of a winch. The log peeler of '437 is designed for an individual to peel logs for his own use and is distinct from the present invention which relates to a machine. Fox, in U.S. Pat. No. 4,595,041, discloses a portable log peeling apparatus having a drawknife. The '437 and '041 art seems geared to the do-it-yourselfer and is not akin to the automated lineal log peeler and debarker of the instant invention.

Other parties in the custom-built log home industry, such as Senty Log Homes (http://senty.com/logs) advertise that their log construction method includes hand-peeling. The dangers and physical difficulty required to peel logs manually with a knife are numerous; the slowness of hand peeling and the skills needed to master this endeavor are additional factors that indicate a need for a lineal log peeler and debarker such as the one disclosed herein by applicant.

The WG Benjey company whose internet link is www-.benjey.com features log home components with a hand-peeled look. The Benjey equipment is available to manufacturers of log homes in various sizes, and priced out of the range of most individual home builders. The Benjey log peelers are available in various sizes. The equipment sold by WG Benjey is distinct from the equipment that is disclosed by applicant in the present invention. Among the differences are the way in which the machines peel logs; the instant invention is a machine that is operated by electricity and requires an operator or automated controller who uses an electronic control panel to guide the machine through its operation, including the initial step of feeding live logs to the machine to the final step of the ejection of debarked logs. The Benjey machine is air-powered and uses a spinning/peeling technique which is distinct from the operation of the instant debarking machine.

Additional prior art includes patents that relate to lathing or ring debarking of logs. The products of logs treated thusly are smooth and regularly shaped pole-like wood products. An example of such prior art is typified by Koike in U.S. Pat. No. 4,901,777. Logs may be peeled in order to produce wood veneer as shown by Platt in U.S. Pat. No. 4,579,159. Further prior art concerning log debarking includes U.S. Pat. No. 4,784,196 to Pousette. Disclosed in '196 is a method and apparatus that produces logs peeled in a bark/no bark alternating style that resembles a barber pole pattern on a log's surface. A second debarking process occurs to remove remaining bark.

It is an object of the present invention to furnish a machine that safely and automatically debarks logs. In one preferred embodiment, the machine is controlled by an operator who sits in a control booth from which he controls the speed of the cutterhead carriage and a plurality of other controls that move a series of logs through the debarking process. The logs are then stored for use in a particular home building project.

It is a further object of this invention to provide a method for peeling logs with a natural, hand-peeled look for use in the log home construction industry. The method safely and efficiently prepares the logs for log home construction and avoids the use of hand-peeling with a drawknife. The logs debarked by the machine of this invention can range in length from about 6 to over 50 feet. They can range from about 7 to about 21 inches in diameter and weigh up to about 3000 pounds.

Another object of this invention is to provide a machine that peels and debarks logs with an automatic controller. The safety features which are inherent in the lineal log peeler and debarker are even more apparent when the operation is controlled remotely.

Safety, ease of use and further objects of the invention will be discussed and claimed in the detailed description of preferred embodiments that follows.

SUMMARY OF THE INVENTION

The invention discloses a lineal log peeler and debarker, a uniquely fashioned cutterhead that rotates rapidly and debarks logs two surfaces at a time. The operation is safely controlled by an operator in a protected booth or remotely controlled. The resulting logs are peeled safely, efficiently, and are suitable for use in the modern log home industry. The log peeling and debarking process as described by this invention can easily process about 2000 logs (about 40,000 lineal feet) in about 12 weeks. This produces enough logs, on average, for about 5 homes. A manual undertaking of such an effort would be much more physically taxing and inefficient in comparison.

DEFINITIONS OF TERMS USED IN THIS INVENTION

The following definitions are provided solely for the benefit of the reader, and should not be construed to limit the terms to any specific examples provided. They should also not be construed to be narrower than those accepted by persons of ordinary skill in the art.

In this invention, the term 'live log deck' will mean an electric chain drive that moves or feeds unpeeled logs to the lineal log peeler and debarker In this invention, the term 'off-kick' will mean the act of mechanically lifting, rotating and ejecting the peeled log out of the lineal log peeler and debarker.

In this invention, the term 'chatter' will refer to the undesirable bumps that are left on the log if the cutterhead peels it too slowly.

In this invention, the terms 'dogged' is used when the log is held in place while it is being debarked.

In this invention, 'green' logs are freshly cut; 'dry' logs are those that have been aged for a period of time.

In this invention, a 'pass' through the lineal log peeler and debarker will mean a log receives debarking from one trip of the cutterhead down its length. One pass will simultaneously peel two sides of the log.

DETAILED DESCRIPTION OF PREFERRED EMBODIMENTS

Figure 1:
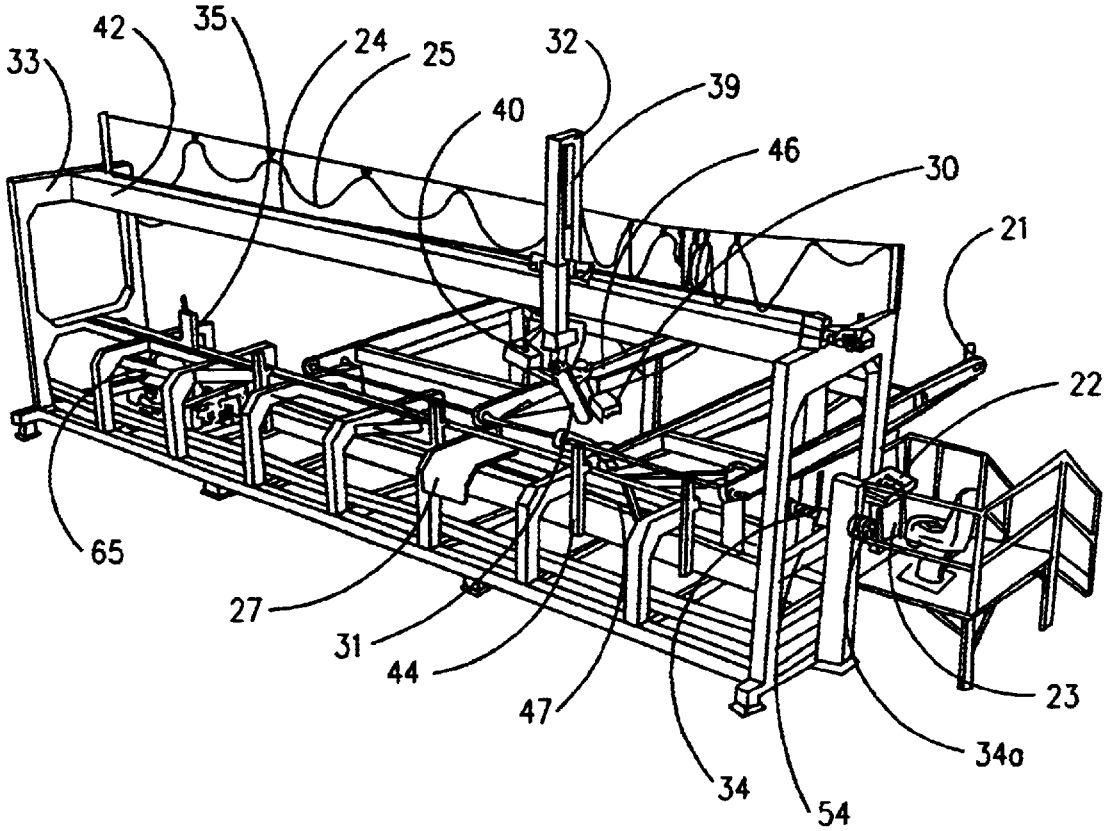
FIG. 1 is a drawing of the lineal log peeler and debarker of this invention.
Figure 2:
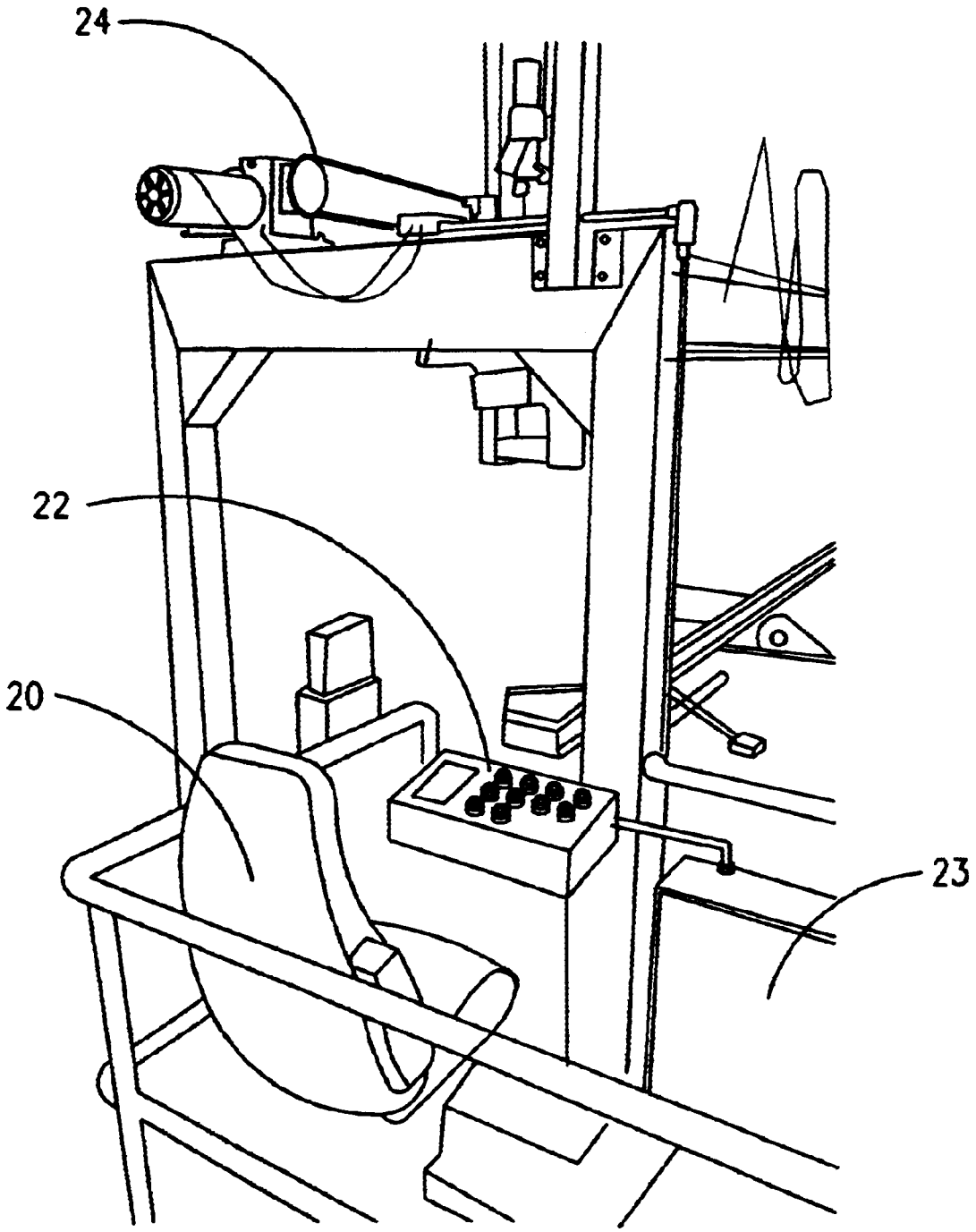
FIG. 2 is a photographic depiction of a side view of the lineal log peeler and debarker showing the operator's area.

In one preferred embodiment, and with reference now to the figures, FIGS. 1 and 2 show that to begin operations of the lineal log peeler and debarker of this invention, an operator sits in a chair 20 in a protected booth equipped with a control panel 22 Besides a Plexiglas panel, the operator wears a hard hat, safety glasses, and hearing protection.

After unlocking the lockout feature with a key (not shown) to start feeding logs 26 to the lineal log peeler and debarker of this invention, he begins feeding logs to the debarker. Logs 26 are delivered to the lineal log peeler and debarker by a front end loader (not shown) where the logs are dropped on a live log deck 21 and fed through the debarking process by the live log deck 21.

As logs 26 flow from a live log deck 21 onto the steel framework where a log kicker arm 44 stops the log 26 and it drops into a trough 47. The log 26 is then is then dogged (held) between the rear drive spindle/sensor 35 and the forward drive spindle/sensor 34 Both spindles are raised lifting the log 26 and approximately 12 inches out of the trough 47 and into position for peeling In the lineal log peeler and debarker of this invention, the forward drive spindle/sensor 34 is motorized and spring-loaded to absorb impact shock. The forward spindle gear box is noted in FIG. 1 as 34*a*. The rear spindle/sensor 35 is not motorized; and it stops the log 26 and dogs it in place for debarking.

The forward- and rear spindle/sensors 34 and 35, are manufactured by the Eaton Corporation's Cutler-Hammer business unit. They are model number E505A, 120 volt, 6 amp sensors. These sensors and similar electronic devices, are widely available and useful in machines with a variety of moving parts that depend on electronic sensors for proper operation.

At this time, the cutterhead 28 is lowered by the cutterhead carriage 32 by the operator into position for debarking. To begin debarking, the cutterhead 28 travels slowly down the length of the log 26.

Figure 3:
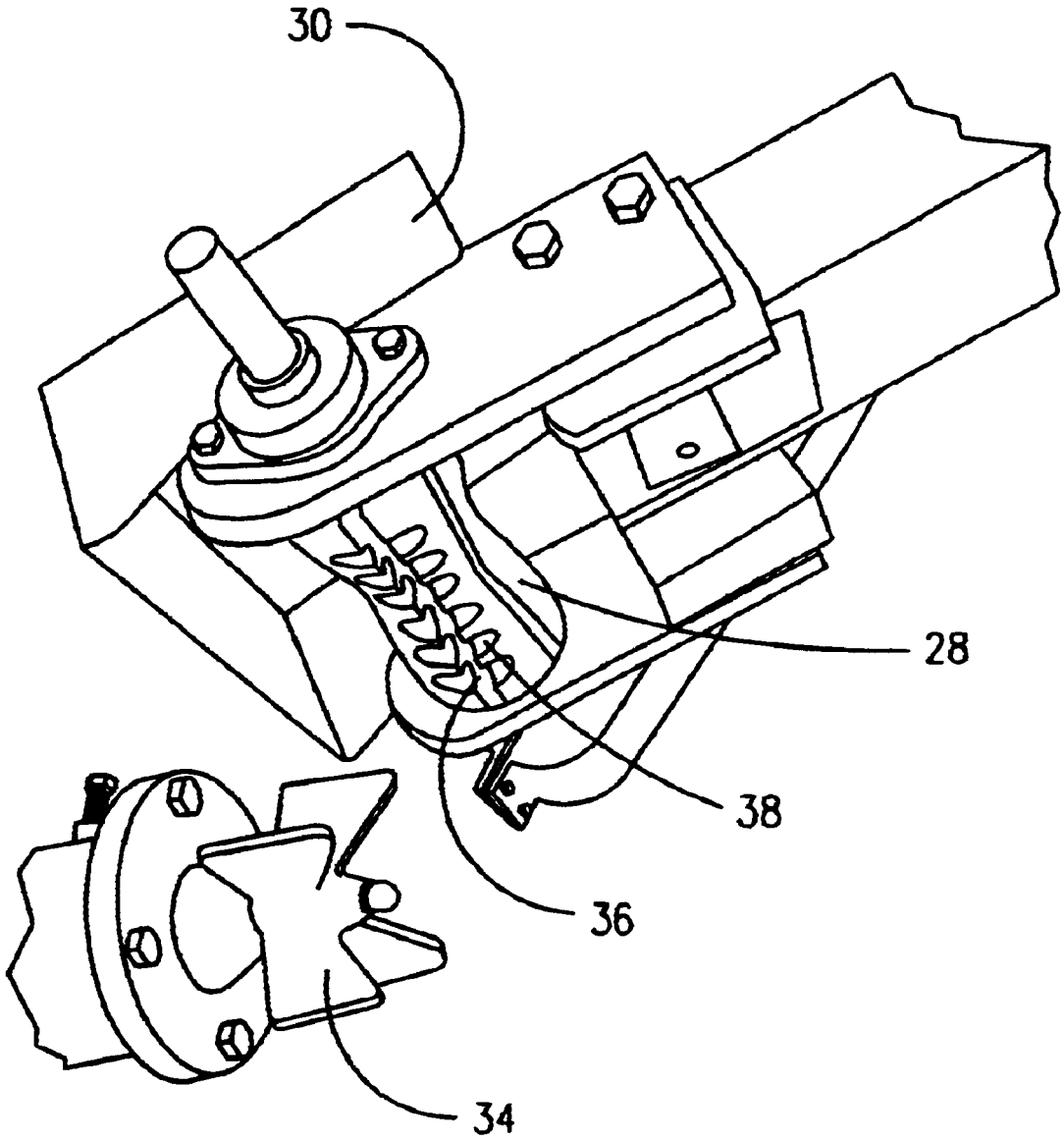
FIG. 3 is a close-range photographic depiction of the cutterhead of the lineal log peeler and debarker of this invention.

As seen in FIG. 3, the cutterhead 28 is made in an hourglass shape. The cutterhead 28 is enclosed in a cutterhead carriage 32 and travels the full length of the log 26 on a motorized chain drive 24 along an overhead steel beam 42. The cutterhead 28 is protected by a cutterhead guard 30. Electric sensors in the cutterhead carriage 32 stop the cutterhead carriage 32 when it reaches the end of the log 26 that is being peeled as it contacts the rear drive spindle/sensor 35.

Built into the cutterhead carriage 32 is an electric cylinder 39 that raises and lowers the carriage 32 containing the cutterhead 28 down on the log 26 so that peeling can occur. When peeling is done, the electric cylinder 39 raises the cutterhead 28 so that the chain drive 24 and returns it to the other end of the log 26.

The cutterhead 28 is made of an aluminum alloy and shaped in an hourglass design, as shown in FIG. 3. It is comprised of six 4-inch planer knives 36 made of hardened steel, that bolt into the cutterhead 28 The blades are easily removed for sharpening by loosening the bolts 38 that hold them in place. The two sides of the hourglass shape are separated by about seven (7) degrees. The 7 degree angle of separation was designed for processing logs with a diameter ranging from about 8 inches to about 16 inches. Other angles would be suitable for logs with different diameters The angular separation allows the cutterhead 28 to peel two surfaces of the log 26 on each pass that it makes lineally down the length of the log 26.

It should be noted that the cutterhead 28 can travel with variable speeds which are controlled by the operator. The variable speed feature of the lineal log peeler and debarker is significant in a number of ways. First, it can peel as slowly as needed by the nature and type of wood the log to be peeled. If a log is quite bumpy, the peeling will have to be more slow than if the log is more smooth so that the cutterhead 28 and its knives 36 capture the shape of the log when it is debarked.

Figure 4:
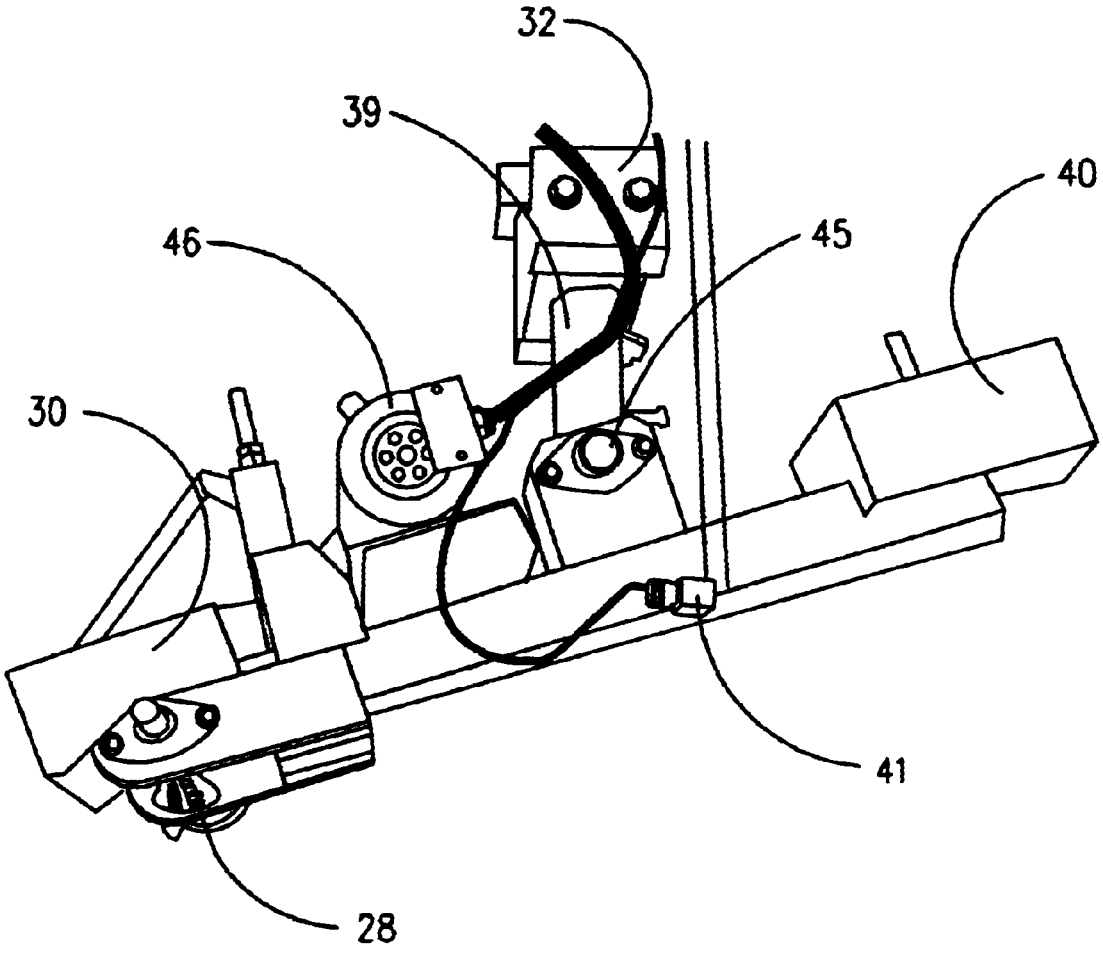
FIG. 4 is a photographic depiction of the cutterhead carriage
Figure 6:
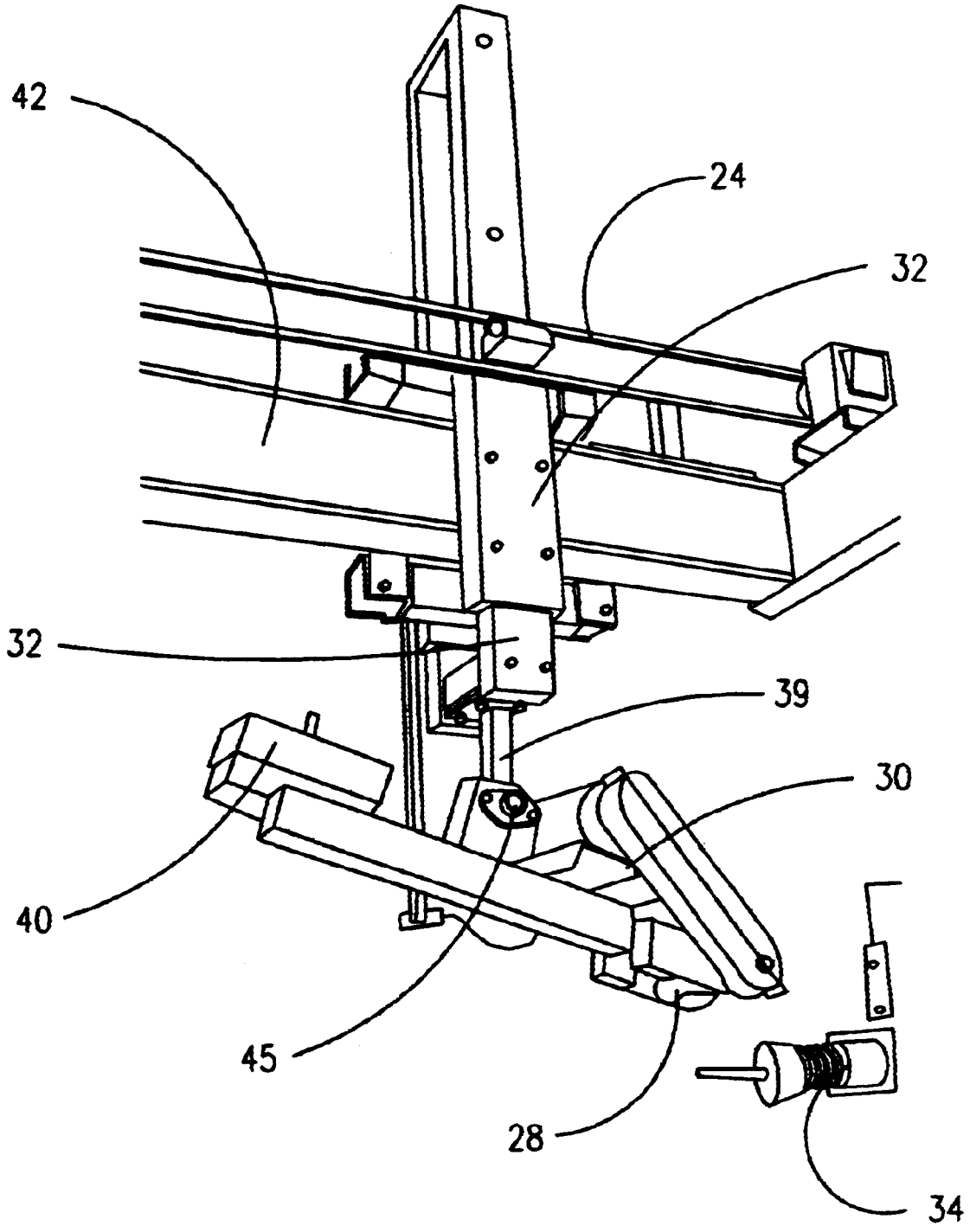
FIG. 6 is a photographic depiction of an upper view of the cutterhead carriage of this invention.

While traversing the length of the log 26, the cutterhead 28 spins rapidly at a rate of about 6,300 rpm. As shown in FIG. 4 and FIG. 6, a counterweight 40 is present on the other end of the cutterhead carriage 32. The counterweight 40 is present on the cutterhead carriage 32 so that the cutterhead 28 is cantilevered on a pivot 45 and can rotate and smoothly peel the log 26 along the contours of its surface. Also shown in FIG. 4 is the cutterhead motor 46. The resulting peeled log 26, processed thusly, retains the shape of the log's contours.

The peeled log 26 has a natural, hand-hewn appearance.

Figure 5:
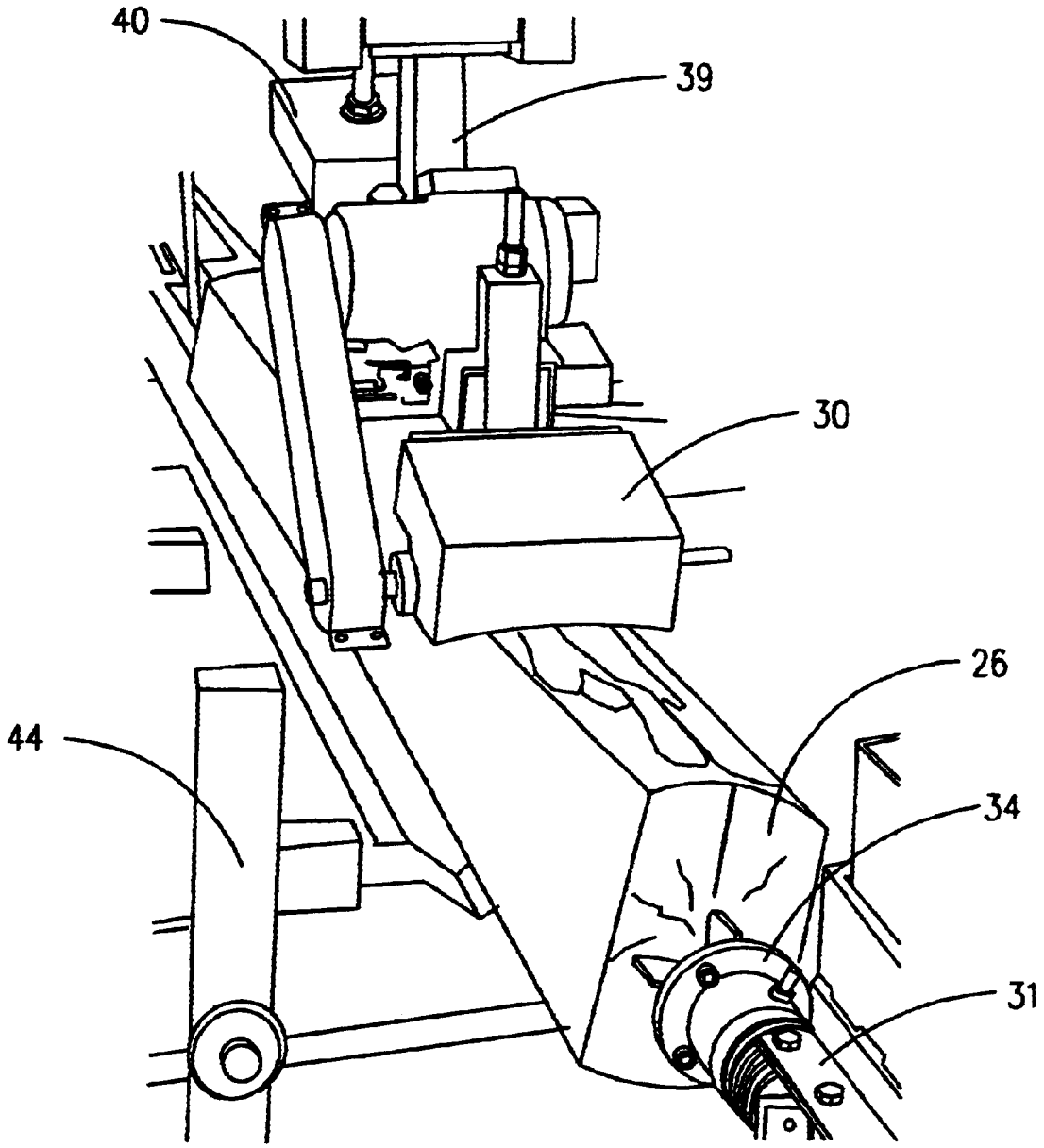
FIG. 5 is a photographic depiction of a log being debarked by the cutterhead of this invention.

When peeling a log 26, as shown in FIG. 5, the cutterhead carriage 32 can travel much faster to its starting position at the forward drive spindle/sensor 34 when it is elevated above the log 26 and travels without cutting. In this way, the operator can rotate the log 26 and then position the cutterhead carriage 32 to peel the next surface. The log 26 is rotated by the motorized forward drive spindle/sensor 34. The number of rotations required for complete debarking will the depend on the length and diameter of the log being peeled. An average number of passes that will be needed for debarking a log may range from about 10 to about 14, with an average number of passes being about 12.

When the log is totally peeled, the rear drive spindle/sensor 35 releases its hold on the log 26 and it falls into the trough 47. The operator activates the push kicker 54 to push the log 26 away from the forward drive spindle/sensor 34. The operator then activates the log kicker arm 44 to remove the peeled log 26 from the lineal log peeler and debarking machine.

Figure 7:
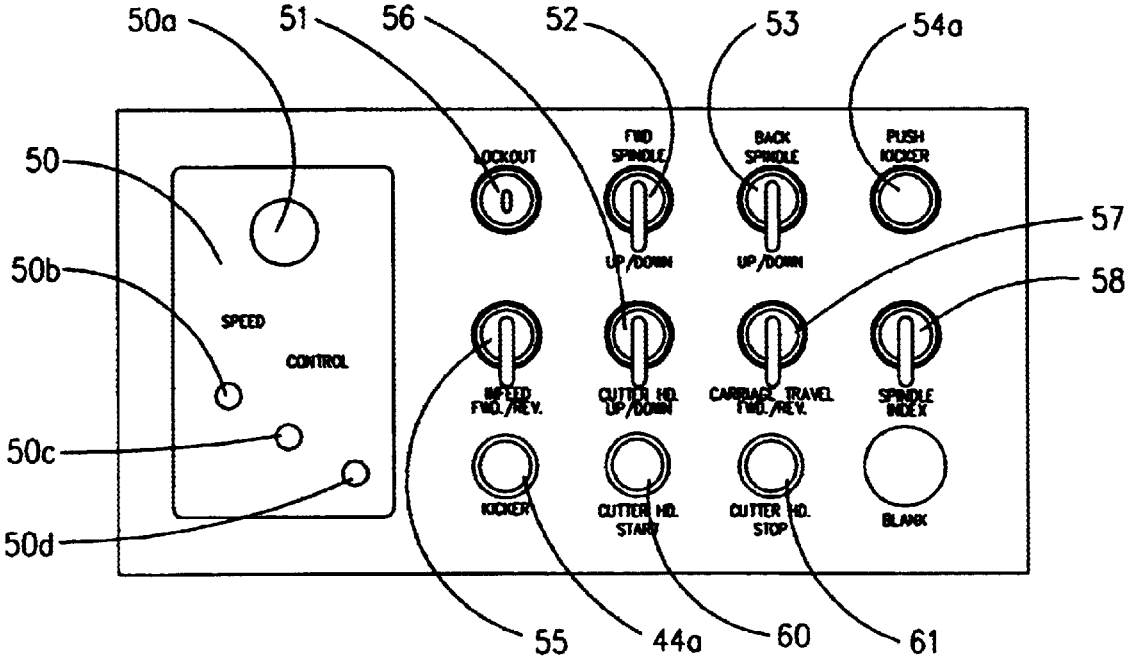
FIG. 7 is a diagram of the operator console of the lineal log peeler and debarker of this invention with: controls labeled

Regarding the operator's control panel 22 as shown in FIG. 7, each pad is labeled to indicate its function starting with the speed control panel 50. The speed control panel controls the speed of the cutterhead carriage 32. The speed of the cutterhead carriage may vary from 0 to 120 feet per minute. As can be seen in FIG. 7, the rectangular speed control panel 50 is comprised on four separate controls. The top control 50*a* is a dial that is a variable speed adjustment, the next control 50*b* is an on/off switch that stops and starts the cutterhead carriage 32. The next speed control dial is 50*c* which changes the direction (forward/reverse) of the cutterhead carriage 32, the next speed control dial is 50*d* which starts movement of cutterhead carriage 32.

To the right of the speed control panel 50 is the lockout switch 51. The lockout switch 51 turns the lineal log peeler and debarker on and off with a key. The lockout switch 51 prevent unauthorized use of the lineal log peeler and debarker. The next switch on the top row of the control panel 22 is the forward spindle/sensor control 52. The forward spindle/sensor control 52 operates the electric cylinder for the forward drive spindle/sensor 34. It moves a log 26 up and down. As a log 26 is dogged endwise, this control raises and lowers the front end of the log 26.

The next switch on the operator control panel 22 is the back spindle control 53. The back spindle control 53 operates the electric cylinder for the rear drive spindle/sensor 35. It raises and lowers the log 26 with the rear drive spindle/sensor 35 The switch on the far right of the top row of the operator control panel 22 operates the push kicker 54. As shown in FIG. 1, the push kicker 54 is an electric cylinder mounted horizontally under the forward drive spindle/sensor 34. After a log 26 is peeled and released by the forward- and rear spindles 34 and 35 and dropped onto a trough 47, the push kicker 54 pushes the log lengthwise at least two inches away from the forward drive spindle/sensor 34, ensuring that the peeled log 26 will not get caught up in the lineal log peeler and debarker equipment. The kicking operation so described is controlled by the operator by switch 54*a*.

On the far left of the second row of switches depicted on the control panel 22 of FIG. 7 is a switch 55 that controls the feeding of logs 26 to the lineal log peeler and debarker from the live log deck 21. Switch 55 operates the forward and reverse movement of logs 26. The next switch 56 on the second row of the control panel 22 is the switch that controls the cutterhead carriage cylinder 39 inside the cutterhead carriage 32. Switch 56 lowers the cutterhead 28 into position to peel a log 26 and raises it to return to the forward drive spindle/sensor 34 where it can again be lowered when needed.

The next switch 57 controls the forward and reverse movement of the lower carriage tail stock 65. This allows different lengths of logs to be end-dogged, peeled, and released. The switch on the far right of the second row of the control panel 22 is the spindle index 58. The spindle index 58 controls an electric motor built into the forward drive spindle/sensor 34 to rotate the log 26. After one side of the log 26 is peeled, the operator uses switch 58 to rotate the log 26 into position for another pass of back removal by the cutterhead 28. As has been stated, the average log will require about twelve passes of the cutterhead 28 to be completely ready for use in home construction.

The bottom row of switches includes the log kicker arm control 44*a*. The kicker control 44*a* operates the log kicker arm 44 in a 360 degree cycle. After a log 26 is released from the spindle/sensors 34 and 35 and pushed away from the forward drive spindle/sensor 34 by the log kicker arm 44, lifts the log 26 up and away from the lineal log peeler machine and out of a trough 47 ejecting the log 26 from the machine.

The next button on the bottom row of the control panel 22 is the cutterhead start 60. The cutterhead start button 60 starts the five horse power motor 46 on the cutterhead 28. In a similar manner, the cutterhead stop button 61 stops the cutterhead motor 46.

EXAMPLES

The following examples will illustrate the operation of the lineal log peeler and debarker of this invention. The first example is a description of an operator-controlled machine peeling a log.

Example 1

Operator Controlled Log Peeling

Sitting in the operator's chair 20, an operator wearing a hard hat (not shown) will turn the machine on by turning a key in the lockout 51. When ready to begin, he will activate the infeed switch 55 that controls the feeding of logs 26 to the lineal log peeler and debarker from the live log deck 21 towards the trough 47.

The log 26 is then dropped into the trough 47 and moves the, infeed 55 back so that other logs are out of the way and the log 26 of interest is ready to be debarked. To do this, the forward drive spindle/sensor 34 and the rear drive spindle/sensor 35 (which are controlled by spindle control buttons 52 and 53, respectively) are activated to grasp or dog the log 26 in place for debarking. The log 26 is end-dogged by moving the lower carriage tail stock 65 forward with the carriage travel control 57.

The log 26 to be peeled is then lifted out of the trough 47 and into peeling position by raising both the forward drive spindle/sensor 34 and the rear drive spindle/sensor 35 by adjusting their respective controls 52 and 53. When the log 26 is ready to be peeled, the operator starts the cutterhead motor 46 by switch 60. The cutterhead carriage cylinder 39 is placed into operation by switch 50*d*. The cutterhead carriage 32 is moved along the log 26 by the operator's control of switch 50*b*. The cutterhead carriage 32 then travels from the forward spindle/sensor 34 to the rear spindle/sensor 35, peeling two sides of the log 26 as it travels the length of the log 26. The movement of the cutterhead carriage 32 is controlled by the operator and switch 50*c*. When the cutterhead carriage reaches the back spindle/sensor 35 the cutterhead carriage 32 is stopped by an electric sensor in the back spindle/sensor 35.

After the cutterhead carriage 32 is stopped, it is raised away from the log by switch 56. The cutterhead carriage 32 is then returned to the starting position of the forward spindle/sensor 34 where it is stopped by an electric sensor therein. The log 26 is then rotated when the operator, who controls the forward spindle/sensor 34 by rotating it, uses switch 58 to do so. When the log 26 is rotated so that another unpeeled side is ready to be debarked, the process is repeated until all the log's surfaces are free of bark.

When the last log of the operator's shift has been debarked, the operator stops the cutterhead motor 46 using control 61. The lower carriage tail stock 65 is moved by switch 57 releasing the log 26 from both the forward spindle/sensor 34 and the rear spindle/sensor 35, and dropping it into the through 47. The push kicker 54 is now activated by switch 54*a*. Lastly, the log kicker arm 44 is activated by switch 44*a* lifting and removing the log 26 away from the debarking machine onto a storage area (not shown). When operations are complete, the operator turns off the machine with a key in the lockout 51.

Example 2

Automatically Controlled Log Peeling

Another example of a preferred embodiment of the instant invention relates to log peeling and debarking using automatic controls. In this embodiment, a human operator is required only in stopping, starting, and troubleshooting situations.

After an operator uses a key to override the lockout 51, all functions of the machine will be activated in the sequence described below. The functions will engage with electric sensors, engaging the functions sequentially in a manner as follows:

a) sensors in the live log deck 21 will activate the chain drive 24 and drop logs 26 into the trough 47 one at a time, including necessary movement to clear other logs from the trough area;

b) lower carriage tail stock 65 automatically opens for the maximum length log 26 to load; forward spindle/sensor 34 and rear spindle/sensor 35 fit the log 26 to a preset diameter;

c) the log 26 is end-dogged by automatic forward movement of the lower carriage tail stock 65;

d) forward spindle/sensor 34 and rear spindle/sensor 35 raise the log 26 into position for peeling and dog it in place;

e) the cutterhead motor 46 automatically turns on and the cutterhead carriage 32 lowers the cutterhead 28 down to peel the log 26 stopping when it reaches the back spindle/sensor 35. It then raises above the log 26, changes directions and returns in at a higher rate of speed to the starting position of the forward spindle/sensor 34 where it is stopped by an electric sensor therein.

The five steps described above complete one peeling cycle. As the cutterhead carriage 32 returns, the forward spindle/sensor 34 automatically rotates the log 26 approximately 30 degrees in one direction. A typical log 26 with a diameter of about twelve inches will require twelve peeling positions.

When the machine finishes peeling a log 26, the cutterhead motor 46 will automatically turn off. The cutterhead carriage 32 automatically returns to its starting point. The lower carriage tail stock 65 opens to the maximum length starting point, and releases the peeled log 26 back into the trough 47. An electric cylinder on the push kicker 54 is automatically activated, and pushes the peeled log away from the forward spindle/sensor 34. The log kicker arm 44 rotates a full 360 degrees, lifting the log 26 up and away from the machine. At this point, the next unpeeled log is moved into the trough 47 by the live log deck 21.

The automated version of the lineal log peeler and debarker of this invention will continue to operate as long as there are logs 26 in the live log deck 21, or until stopped by a human operator. Controls for the automatic operation are sensors similar to the forward- and rear spindle/sensors 34 and 35, which are manufactured by the Eaton Corporation's Cutler-Hammer business unit. They are model number E505A, 120 volt, 6 amp sensors. These sensors and similar electronic devices, are widely available and will be used useful in machines with a variety of moving parts that depend on electronic sensors for proper operation.

Steps a) to e) above in the automated version of the lineal log peeler and debarker of this invention will have electronic sensors incorporated in the live log deck 21, chain drive 24, lower carriage tail stock 65, the cutterhead 28, cutterhead carriage 32, cutterhead motor 46, and the push kicker 54.

DISCUSSION

The above detailed description will enable a person with ordinary skill in the art to build and operate the lineal log peeler and debarker of the present invention. The following information is provided to further describe and provide details that a user may find advantageous in carrying out the operations described.

The lineal log peeler and debarker of this invention is designed to debark logs 26 of all species of trees. The machine is powered by electricity and the debarking operation controlled by an operator in a protected control booth. The electric power supply, 23 is three phase 440 volt.

The lineal log peeler and debarker of this invention may be used indoors or outdoors. If used outdoors, a small roof, canopy or other protective structure can be made to protect the electric motors from inclement weather. Concerning maintenance of the equipment, it is cleaned as needed by an air compressor of leaf blower. The chips of debarked log can be gathered and recycled or otherwise disposed. The knives 36 may be removed from the cutterhead 28 by loosening the bolts 38 and sharpening as needed. Since the lineal log peeler and debarker is a modular piece of equipment, various electric motors can be replaced as needed.

The lineal log peeler and debarker of this invention is made of solid steel, steel tubing, or aluminum alloy. All exposed surfaces are primed and painted for protection from the elements. All movable parts are built with bearings and zirc grease fittings. Chain drive 24 has adjustable tension, and the cutterhead counterweight 40 can be varied if needed. All electric sensors are adjustable as well as they will likely need tightening as tension therein stretches over time.

The cutterhead 28 of the lineal log peeler and debarker may also be adjusted to debark logs of various species of trees. The knives 36 of the cutterhead 28 may be adjusted to cut the logs from ¼ inch to ½ inches deep, as desired by the end user. The end user, in most cases, will be a customer of the owner/operator of the lineal log peeler and debarker who is building a home from the logs being prepared.

A standard log used in the home construction industry is cedar. Cedar logs are usually cut from ½ inch to 1½ inches. Several wood species and the usual depth they are peeled are presented in Table 1 below:

TABLE 1

| | |
|---|---|
| Pine | ¼ inch to 1 inch |
| Fir | ½ inch to 1½ inch |
| Cedar | ½ inch to 1½ inch |
| Spruce | ¼ inch to 1 inch |
| Larch | ½ inch to 1½ inch |

The lineal log peeler and debarker of this invention is able to peel and debark both green and dry logs. The logs debarked by the machine of this invention can range in length from about 6 to over 50 feet. They can range from about 7 to about 21 inches in diameter and weigh up to about 3000 pounds.

The user of the lineal log peeler and debarker of this invention may reasonably expect to process about 2000 logs (about 40,000 lineal feet) in about 12 weeks. This would produce enough logs, on average, enough logs for about 5 homes.

The lineal log peeler and debarker of this invention is a significant improvement in the log home construction industry. The machine all electric, uses no hydraulics, is easy to maintain, and can be easily adjusted for logs of various trees. Production of peeled logs with this invention reduces worker injuries, as well as the accompanying workers' compensation claims, lost item accidents, and the like.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

What is claimed is:

1. An automated machine that peels logs for use in log home construction industry comprising:

a means to feed a log to a debarker;

a means to move the log through the machine including stopping the log when it is in position to drop into position to be debarked;

a means to lift and rotate the log into position to be peeled by a cutterhead;

a cutterhead carriage which contains the cutterhead and transverses the entire length of the log on an overhead steel beam that stops when it reaches the end of the log;

an electric cylinder means to raise and lower the cutterhead down on the log to peel it;

a weighted, cantilevered cutterhead that rotates and peels logs fed thereto smoothly and along the contours of the log's surface to create a debarked log which retains an uneven and natural appearance; and a means to eject the peeled log away from the machine when it is peeled wherein the machine is controlled electronically by an operator.

2. The machine of claim 1 wherein the logs that are peeled range from about six to about 50 feet in length, from about seven to about 20 inches in diameter, and weigh up to about 3000 pounds.

3. The machine of claim 1 wherein the peeled logs are ejected out of a trough for storage away from the machine after the debarking process is complete.

4. The machine of claim 1 wherein the log debarking is controlled by an operator who is seated and protected from debarked logs, wood debris from the debarked logs, and the debarking equipment by a protected enclosure.

5. The machine of claim 1 wherein the cutterhead is made of an aluminum alloy in an hourglass design and comprises a plurality of planer knives which peels two surfaces of a log as the cutterhead passes over the length of a log.

6. The machine of claim 1 wherein its operation is controlled by an electronic control panel by which an operator controls the speed and position of the unauthorized users, the means for lifting and rotating logs, the means for feeding logs to be debarked, and the means to eject peeled logs away from the debarking equipment.

7. A cutterhead device for the debarking of logs configured in an hourglass shape comprising an electric cylinder mounted on a carriage that raises and lowers a cutterhead into a position to peel a log;

an overhead, chain-driven electric motor mounted on a cutterhead carriage;

a plurality of planer knives that travel the length of a log from one end to the other via a belt-driven pulley that rotates the cutterhead at a speed of at least 6,300 rpm as it debarks the log;

an arm that holds the cutterhead at one end that is balanced with a counterweight ranging from about 50 to about 100 pounds so that the cutterhead can traverse the length of a log and remove the bark from a log while pivoting so that the log is debarked along the natural contours of the log to produce a peeled log with a hand-hewn appearance.

8. The cutterhead device of claim 7 wherein logs are debarked with an uneven, natural finish is made possible by an hourglass shape with an angle of separation of about 7 (seven) degrees that allows it to glide along the surface of the log so that the knives contained therein peel the bark while retaining the log's natural shape.

9. The cutterhead device of claim 7 wherein debarking of logs is accomplished by six four-inch planer knives which are positioned circumferentially around the sides of the cutterhead.

10. The cutterhead device of claim 7 wherein each log is debarked by peeling two surfaces at a time.

11. The cutterhead device of claim 7 wherein each log fed thereto is peeled from one end to the other before it is released into a holding area for peeled logs outside of the cutterhead device.

12. The cutterhead device of claim 7 which is controlled by an operator who remotely manipulates the on, off, and stop position of the cutterhead carriage;

the speed of the cutterhead carriage as it traverses a log;

the direction of movement of the cutterhead carriage;

the vertical movement of the cutterhead as it is lowered down to peel a log and raised up and moved away from the log's surface and sent back to be rotated into position for the debarking of the log's next unpeeled surface.

13. A process for peeling logs for use in log home construction, comprising providing an automated machine that is controlled by an operator that feeds logs to a debarker and further comprising the steps of:

a) feeding logs from a front-end loader to a debarking machine with an electric chain drive;

b) dropping logs into a trough;

c) loading the logs between forward and back spindles which raise and lower the log into position for debarking;

d) dogging the logs firmly in place for debarking;

e) raising the log into peeling position;

f) peeling the log by multiple passes of a cutterhead on the log, g) repeating the peeling step as needed to achieve a desired finish, h) ejecting the log from the debarker when the log is completely peeled.

14. The process of claim 13 wherein the operator is protected from injury by sitting in a protected enclosure that allows the process to be monitored.

15. The process of claim 13 wherein the peeled logs retain their natural contours as desired by a user after debarking.

16. The process of claim 13 wherein safety features include protection of the operator by both a Plexiglas shield and the cutterhead by a metal cutterhead guard.

17. The process of claim 13 wherein a log is peeled by the cutterhead by an operator who controls the debarking process by lowering the cutterhead into a peeling position where debarking occurs as it traverses the length of the log at a preset forward speed;

reaching the back spindle after debarking of a log surface is complete;

raising the cutterhead above the debarked surface;

returning to the opposite end of the log at a higher speed than the preset forward speed;

rotating the log about thirty degrees; and repeating the process until the log is debarked.

18. The process of claim 13 wherein from about ten to fourteen passes are required to debark a log meant for home construction.

19. The process of claim 13 wherein the logs that are peeled for use in home construction are selected from the group consisting of pine, fir, cedar, spruce, and larch.

20. A process for automatically peeling logs for use in log home construction, comprising providing an automated machine that feed logs to a debarker and further comprising the steps of:

a) activating a chain drive and dropping logs into a trough one at a time, including clearing other logs from the trough area;

b) automatic opening of a cutterhead carriage to a maximum length log while a forward spindle and a rear spindle are fitting the log to a preset diameter;

c) dogging the log automatically by movement of a lower carriage tail stock, d) raising the log by moving the forward spindle and rear spindle into position for peeling and dogging it in place;

e) turning on a cutterhead motor which initiates moving a cutterhead carriage down the log from via an upper carriage, stopping when it reaches the back spindle;

f) raising the cutterhead motor above the log, changing directions and returning at a higher rate of speed to the starting position of the forward spindle where it is stopped by an electric sensor.

21. The process of claim 20 wherein the stated steps of log peeling occur automatically in sequence by means of electric sensors in the order specified, starting each step immediately after completing the previous step.

22. The process of claim 20 wherein routine operation of the machine is accomplished remotely by an automatic controller.

* * * * *

UNITED STATES PATENT AND TRADEMARK OFFICE

CERTIFICATE OF CORRECTION

PATENT NO. : 6,675,846 B1
DATED : January 13, 2004
INVENTOR(S) : Hoffman, James D.

It is certified that error appears in the above-identified patent and that said Letters Patent is hereby corrected as shown below:

Column 10,
Line 21, claim 6 should read -- The machine of claim 1 wherein its operation is controlled by an electronic control panel by which an operator controls the speed and position of the cutterhead carriage, a keyed lockout switch that prevents operation by unauthorized users, the mean for lifting and rotating logs, the means for feeding logs to be debarked, and the means to eject peeled logs away from the debarking equipment. --

Signed and Sealed this

Fifteenth Day of June, 2004

JON W. DUDAS
*Acting Director of the United States Patent and Trademark Office*